US009764810B1

(12) United States Patent
Andrasko et al.

(10) Patent No.: US 9,764,810 B1
(45) Date of Patent: Sep. 19, 2017

(54) METHODS FOR POSITIONING MULTIPLE TRIMMABLE MARINE PROPULSION DEVICES ON A MARINE VESSEL

(71) Applicant: Brunswick Corporation, Lake Forest, IL (US)

(72) Inventors: Steven J. Andrasko, Oshkosh, WI (US); Brad E. Taylor, Dallas, TX (US); Steven M. Anschuetz, Fond du Lac, WI (US)

(73) Assignee: Bruswick Corporation, Lake Forest, IL (US)

( * ) Notice: Subject to any disclaimer, the term of this patent is extended or adjusted under 35 U.S.C. 154(b) by 0 days.

(21) Appl. No.: 15/147,264

(22) Filed: May 5, 2016

Related U.S. Application Data

(60) Provisional application No. 62/183,398, filed on Jun. 23, 2015.

(51) Int. Cl.
*B63H 20/10* (2006.01)
*B63H 25/02* (2006.01)
*B63H 20/00* (2006.01)

(52) U.S. Cl.
CPC ..... *B63H 20/10* (2013.01); *B63H 25/02* (2013.01); *B63H 2020/003* (2013.01); *B63H 2025/022* (2013.01)

(58) Field of Classification Search
CPC .. B63H 20/10; B63H 25/02; B63H 2020/003; B63H 2025/022
See application file for complete search history.

(56) References Cited

U.S. PATENT DOCUMENTS 3,682,127 A * 8/1972 Waquet ..... B63H 1/38 440/12.65
3,777,694 A 12/1973 Best
(Continued)

FOREIGN PATENT DOCUMENTS

EP 2368791 1/2013

OTHER PUBLICATIONS

Andrasko et al., "Systems and Methods for Providing Notification Regarding Trim Angle of a Marine Propulsion Device", Unpublished U.S. Appl. No. 14/573,200, filed Dec. 17, 2014.
(Continued)

*Primary Examiner* — Behrang Badii
*Assistant Examiner* — Daniel L Greene
(74) *Attorney, Agent, or Firm* — Andrus Intellectual Property Law, LLP

(57) ABSTRACT

A method for positioning two or more trimmable marine propulsion devices coupled to a transom of a marine vessel includes identifying two propulsion devices located one on each of a port side and a starboard side of a centerline of the transom and spaced symmetrically with respect to the centerline. The two propulsion devices are defined as a first set and are associated with a first target trim position. The method also includes defining a second set of propulsion devices and associating the second set with a second target trim position. When in auto-trim mode, each propulsion device in a set of propulsion devices is actuated to its target trim position only if the actual trim positions of all propulsion devices in the set differ from the target trim position by at least a given amount. The propulsion devices may be actuated individually in response to a user sync command.

19 Claims, 7 Drawing Sheets

(56) References Cited

U.S. PATENT DOCUMENTS 3,834,345 A * 9/1974 Hager ..... G05D 3/00 440/1
3,999,502 A 12/1976 Mayer
4,050,359 A 9/1977 Mayer
4,318,699 A 3/1982 Wenstadt et al.
4,413,215 A * 11/1983 Cavil ..... G05D 1/0206 114/144 RE
4,490,120 A 12/1984 Hundertmark
4,565,528 A 1/1986 Nakase
4,718,872 A 1/1988 Olson et al.
4,749,926 A * 6/1988 Ontolchik ..... G05D 1/0875 318/588
4,776,818 A 10/1988 Cahoon et al.
4,824,407 A 4/1989 Torigai et al.
4,836,810 A 6/1989 Entringer
4,861,292 A 8/1989 Griffiths et al.
4,872,857 A 10/1989 Newman et al.
4,898,563 A 2/1990 Torigai et al.
4,908,766 A 3/1990 Takeuchi
4,931,025 A 6/1990 Torigai et al.
4,939,660 A 7/1990 Newman et al.
4,940,434 A 7/1990 Kiesling
4,957,457 A 9/1990 Probst et al.
5,113,780 A 5/1992 Bennett et al.
5,118,315 A 6/1992 Funami et al.
5,142,473 A * 8/1992 Davis ..... B63B 39/14 440/1
5,171,172 A 12/1992 Heaton et al.
5,263,432 A * 11/1993 Davis ..... B63B 39/061 114/286
5,352,137 A 10/1994 Iwai et al.
5,366,393 A 11/1994 Uenage et al.
5,385,110 A 1/1995 Bennett et al.
5,474,012 A * 12/1995 Yamada ..... B63B 39/061 114/286
5,474,013 A 12/1995 Wittmaier
5,507,672 A 4/1996 Imaeda
5,540,174 A 7/1996 Kishi et al.
5,647,780 A 7/1997 Hosoi
5,683,275 A 11/1997 Nanami
5,707,263 A 1/1998 Eick et al.
5,785,562 A 7/1998 Nestvall
5,832,860 A 11/1998 Lexau
5,879,209 A 3/1999 Jones
6,007,391 A 12/1999 Eilert
6,095,077 A 8/2000 DeAgro
6,167,830 B1 1/2001 Pilger
6,273,771 B1 8/2001 Buckley et al.
6,298,824 B1 10/2001 Suhre
6,322,404 B1 11/2001 Magee et al.
6,354,237 B1 3/2002 Gaynor et al.
6,458,003 B1 10/2002 Krueger
6,583,728 B1 6/2003 Staerzl
6,587,765 B1 * 7/2003 Graham ..... B63H 21/21 440/84
6,733,350 B2 5/2004 Iida et al.
6,745,715 B1 6/2004 Shen et al.
6,994,046 B2 2/2006 Kaji et al.
6,997,763 B2 2/2006 Kaji
7,142,955 B1 * 11/2006 Kern ..... B63H 21/213 440/84
7,143,363 B1 11/2006 Gaynor et al.
7,156,709 B1 1/2007 Staerzl et al.
7,188,581 B1 3/2007 Davis et al.
7,311,058 B1 12/2007 Brooks et al.
7,347,753 B1 3/2008 Caldwell et al.
7,389,165 B2 6/2008 Kaji
7,416,456 B1 8/2008 Gonring et al.
7,462,082 B2 12/2008 Kishibata et al.
7,530,865 B2 5/2009 Kado et al.
7,543,544 B2 6/2009 Yap
7,617,026 B2 11/2009 Gee et al.
7,641,525 B2 1/2010 Morvillo
7,942,711 B1 5/2011 Swan
7,958,837 B1 6/2011 Fraleigh
7,972,243 B2 7/2011 Kado et al.
8,011,982 B1 9/2011 Baier et al.
8,113,892 B1 2/2012 Gable et al.
8,145,370 B2 3/2012 Borrett
8,216,007 B2 7/2012 Moore
8,261,682 B1 9/2012 DeVito
8,376,791 B2 2/2013 Chiecchi
8,376,793 B2 2/2013 Chiecchi
8,388,390 B2 3/2013 Kuriyagawa et al.
8,428,799 B2 4/2013 Cansiani et al.
8,444,446 B2 5/2013 Kuriyagawa et al.
8,457,820 B1 6/2013 Gonring
8,480,445 B2 7/2013 Morvillo
8,583,300 B2 11/2013 Oehlgrien et al.
8,622,777 B1 1/2014 McNalley et al.
8,631,753 B2 1/2014 Morvillo
8,740,658 B2 6/2014 Kuriyagawa
8,762,022 B1 6/2014 Arbuckle et al.
8,807,059 B1 8/2014 Samples et al.
8,855,890 B2 10/2014 Egle et al.
8,858,278 B2 10/2014 Morvillo
9,052,717 B1 6/2015 Walser et al.
9,068,855 B1 6/2015 Guglielmo
9,156,536 B1 10/2015 Arbuckle et al.
9,278,740 B1 3/2016 Andrasko et al.
9,290,252 B1 3/2016 Tuchscherer et al.
9,381,989 B1 7/2016 Poirier
2003/0013359 A1 1/2003 Suganuma et al.
2005/0245147 A1 11/2005 Takada et al.
2007/0089660 A1 4/2007 Bradley et al.
2010/0248560 A1 * 9/2010 Ito ..... B63H 21/22 440/1
2011/0263167 A1 10/2011 Chiecchi
2013/0312651 A1 11/2013 Gai
2013/0340667 A1 12/2013 Morvillo
2014/0209007 A1 7/2014 Morvillo
2014/0224166 A1 8/2014 Morvillo
2014/0295717 A1 10/2014 Kuriyagawa et al.
2016/0068247 A1 3/2016 Morvillo

OTHER PUBLICATIONS

Poirier, Brian, "System and Method for Positioning a Drive Unit on a Marine Vessel," Unpublished U.S. Appl. No. 14/177,767 filed Feb. 11, 2014.
Andrasko et al., "Systems and Methods for Controlling Movement of Drive Units on a Marine Vessel", Unpublished U.S. Appl. No. 14/177,762, filed Feb. 11, 2014.
Andrasko et al., "Systems and Methods for Automatically Controlling Attitude of a Marine Vessel with Trim Devices", Unpublished U.S. Appl. No. 14/873,803, filed Oct. 2, 2015.
Mercury Marine, 90-8M0076286 JPO Service Manual—Auto Trim Portion, Theory of Operation, Jul. 2013, p. 2A-5.
Mercury Marine, 90-8M0081623 JPO Owners Manual—Auto Trim Portion, Section 2—On the Water, May 2013, p. 21.
O'Brien et al., "Systems and Methods for Setting Engine Speed Relative to Operator Demand", Unpublished U.S. Appl. No. 14/684,952, filed Apr. 13, 2015.
Anschuetz et al., "System and Method for Trimming a Trimmable Marine Device with Respect to a Marine Vessel", Unpublished U.S. Appl. No. 15/003,326, filed Jan. 21, 2016.
Anschuetz et al., "System and Method for Trimming a Trimmable Marine Device with Respect to a Marine Vessel", Unpublished U.S. Appl. No. 15/003,335, filed Jan. 21, 2016.
Dengel et al., "Trim Control Systems and Methods for Marine Vessels", Unpublished U.S. Appl. No. 13/770,591, filed Feb. 19, 2013.

* cited by examiner

METHODS FOR POSITIONING MULTIPLE TRIMMABLE MARINE PROPULSION DEVICES ON A MARINE VESSEL

CROSS REFERENCE TO RELATED APPLICATION

The present application claims the benefit of U.S. Provisional Application Ser. No. 62/183,398, filed Jun. 23, 2015, which is hereby incorporated herein by reference.

FIELD

The present disclosure relates to methods for positioning multiple trimmable devices, such as outboard motors or sterndrives, coupled to a transom of a marine vessel.

BACKGROUND

Each of the below U.S. patents and applications is hereby incorporated herein by reference.

U.S. Pat. No. 4,050,359 discloses a hydraulic system for a combined power trim and shock absorbing piston-cylinder unit of an outboard motor that includes a reversible pump means having a trim-up port connected by a pressure responsive pilot valve piston cylinder units and a trim-down port through a reverse lock solenoid valve and a down-pilot spool valve providing full drain flow for trim-up and power flow for trim-down. An up-reverse pilot valve with a pressure operator is in parallel with the reverse lock valve and provides a restricted by-pass for limited trim-up in reverse. The trim-up hydraulic input or powered side of the cylinder units define a trapped hydraulic system creating memory in the system so after impact the motor returns to the original trim position. The return side permits relatively free-flow to permit trail-out under low impact. At high speed impact, the flow is restricted and cylinder pressure increases. At a selected point, a shock valve within the piston-cylinder opens and absorbs the shock forces. The piston unit includes an inner floating head telescoped into a head secured to the piston rod with a chamber thereby formed to store the liquid flow during shock movement. A metered orifice and check valve allows return to the original trim-set position.

U.S. Pat. No. 4,318,699 discloses a sensor that responds to the operation of a marine transportation system to sense on-plane and off-plane conditions of a boat to operate a trim control to automatically position a trimmable drive for a desired boating operation. The preferred embodiment senses engine speed while an alternative embodiment senses fluid pressure opposing boat movement. The drive is moved to an auto-out position at high speeds and to a trimmed-in position at lower speeds.

U.S. Pat. No. 4,490,120 discloses a hydraulic system for trimming and tilting an outboard propulsion unit, which includes both trim piston-cylinder units and a trim-tilt piston-cylinder unit. The flow of hydraulic fluid from the reversible pump is controlled by a spool valve. A pressure relief valve is mounted in the spool to maintain pressure on one side of the spool when the pump is turned off to rapidly close the return valve and prevent further movement of the piston-cylinder units.

U.S. Pat. No. 4,776,818 discloses an electrical control system for trimming a pair of stern motors or drives mounted side-by-side on a boat. The two drives are both jointly and independently movable through a plurality of trim positions. The system includes two trim cylinders, each coupled to one associated drive, to move its associated drive to different trim positions both jointly as well as independently of each other. An operator controlled mechanism energizes and de-energizes the two trim cylinders simultaneously to jointly vary the trim position of the two drives. Two lines, each coupled at its first end to one associated drive, independently detect both the angular trim position of its associated drive with respect to the other drive as well as detect the trim position of the two drives jointly. Automatic control means coupled to the second end of each of the two lines is responsive to the two lines, when the two drives are not in the desired equal trim position with respect to each other, and controls switches to inactivate one of the trim cylinders and thereby move the other of the trim cylinders with respect to the inactivated one trim cylinder until the desired equal trim position is achieved between the two drives.

U.S. Pat. No. 4,861,292 discloses a system for optimizing the speed of a boat at a particular throttle setting that utilizes sensed speed changes to vary the boat drive unit position vertically and to vary the drive unit trim position. The measurement of boat speed before and after an incremental change in vertical position or trim is used in conjunction with a selected minimum speed change increment to effect subsequent alternate control strategies. Depending on the relative difference in before and after speeds, the system will automatically continue incremental movement of the drive unit in the same direction, hold the drive unit in its present position, or move the drive unit an incremental amount in the opposite direction to its previous position. The alternate control strategies minimize the effects of initial incremental movement in the wrong direction, eliminate excessive position hunting by the system, and minimize drive unit repositioning which has little or no practical effect on speed.

U.S. Pat. No. 6,007,391 discloses an automatically adjustable trim system for a marine propulsion system that provides automatic trimming of the propeller in response to increased loads on the propeller. A propulsion unit is attached to a boat transom through a tilt mechanism including a transom bracket and a swivel bracket. In a first embodiment, the transom bracket is clamped to a flexible transom which flexes in response to forces exerted on the transom during acceleration. In a second embodiment, the transom bracket is clamped to a transom bracket mounting platform that is generally parallel to and pivotally attached to the transom. A trim angle biasing mechanism is mounted between the transom and the transom bracket mounting platform for automatically adjusting the trim angle. A third embodiment includes a trim angle biasing mechanism incorporated into the transom bracket or swivel bracket. A fourth embodiment includes a spring-loaded pawl assembly between the swivel bracket and transom bracket.

U.S. Pat. No. 7,347,753 discloses a hydraulic system for a sterndrive marine propulsion device that directs the flow of hydraulic fluid through the body and peripheral components of a gimbal ring in order to reduce the number and length of flexible hydraulic conduits necessary to conduct pressurized hydraulic fluid from a pump to one or more hydraulic cylinders used to control the trim or tilt of a marine drive unit relative to a gimbal housing.

U.S. Pat. No. 7,416,456 discloses an automatic trim control system that changes the trim angle of a marine propulsion device as a function of the speed of the marine vessel relative to the water in which it is operated. The changing of the trim angle occurs between first and second speed magnitudes which operate as minimum and maximum speed thresholds.

Unpublished U.S. patent application Ser. No. 14/873,803, filed Oct. 2, 2015, and assigned to the Applicant of the present application, discloses systems and methods for controlling position of a trimmable drive unit with respect to a marine vessel. A controller determines a target trim position as a function of vessel or engine speed. An actual trim position is measured and compared to the target trim position. The controller sends a control signal to a trim actuator to trim the drive unit toward the target trim position if the actual trim position is not equal to the target trim position and if at least one of the following is true: a defined dwell time has elapsed since a previous control signal was sent to the trim actuator to trim the drive unit; a given number of previous control signals has not been exceeded in an attempt to achieve the target trim position; and a difference between the target trim position and the actual trim position is outside of a given deadband. The method may include sending a second control signal for a defined brake time to trim the drive unit in an opposite, second direction in response to a determination that the actual trim position has one of achieved and exceeded the target trim position.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure is of a method for positioning two or more trimmable marine propulsion devices coupled to a transom of a marine vessel and powered by internal combustion engines, the method being carried out by a controller. The method includes identifying two propulsion devices located one on each of a port side and a starboard side of a vertical centerline of the transom and spaced symmetrically with respect to the centerline of the transom, and defining the two propulsion devices as a first set of propulsion devices. The method also includes setting a first target trim position for the first set of propulsion devices as a function of a vessel operating condition, and determining if an actual trim position of each propulsion device in the first set of propulsion devices differs from the first target trim position by at least a given amount. Each propulsion device in the first set of propulsion devices is actuated to the first target trim position only if the actual trim positions of all propulsion devices in the first set of propulsion devices differ from the first target trim position by at least the given amount.

In another example of the present disclosure, another method for positioning two or more trimmable marine propulsion devices coupled to a transom of a marine vessel and powered by internal combustion engines includes identifying two propulsion devices located one on each of a port side and a starboard side of a vertical centerline of the transom and spaced symmetrically with respect to the centerline of the transom, and defining the two propulsion devices as a first set of propulsion devices. The method also includes identifying at least one additional propulsion device coupled to the transom of the marine vessel and defining the at least one additional propulsion device as a second set of propulsion devices. The method comprises setting a first target trim position for the first set of propulsion devices and setting a second target trim position for the second set of propulsion devices. A controller sets the first and second target trim positions according to one of the following: (a) in response to a user sync command; or (b) automatically as a function of a vessel operating condition.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
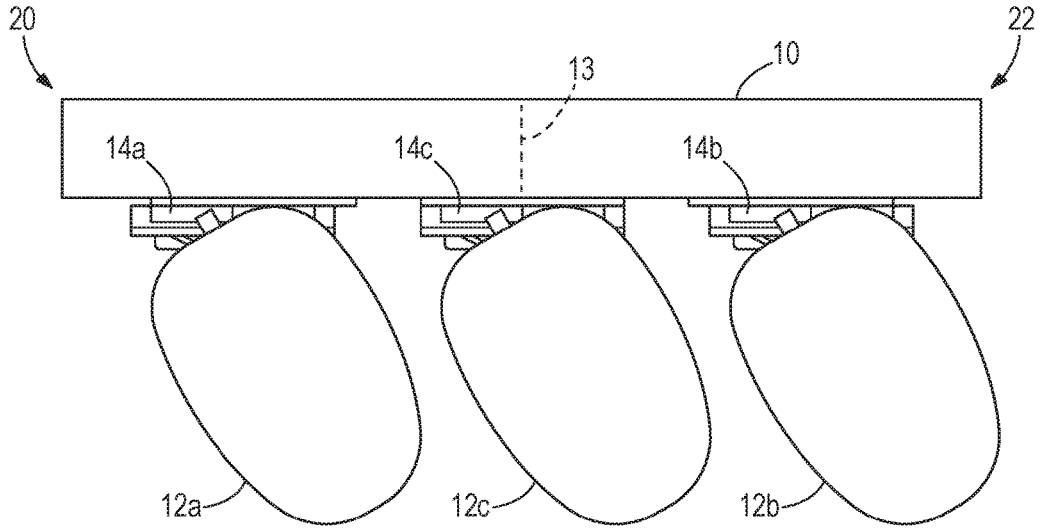
FIG. 1 illustrates one example of a transom of a marine vessel shown from a top view with three outboard motors coupled thereto.
Figure 2:
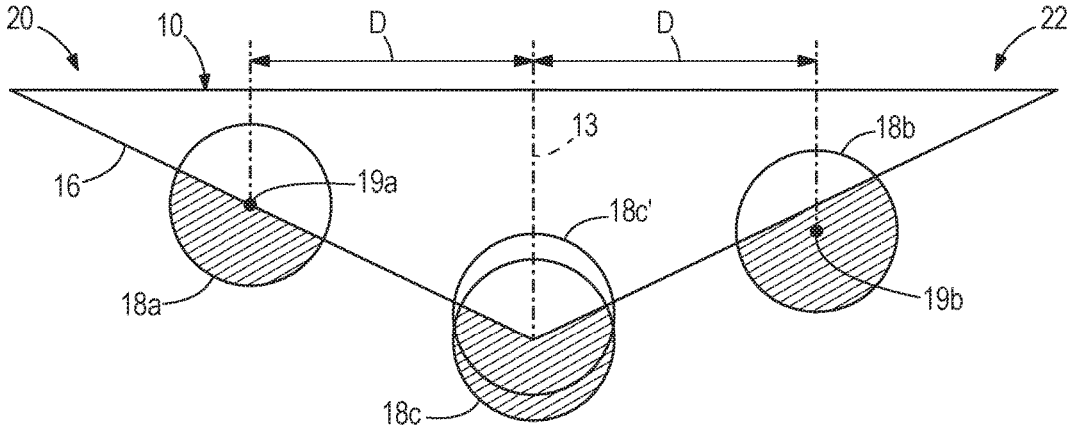
FIG. 2 shows a schematic rear view of a V-shaped transom with three propeller outlines illustrated thereon.
Figure 3:
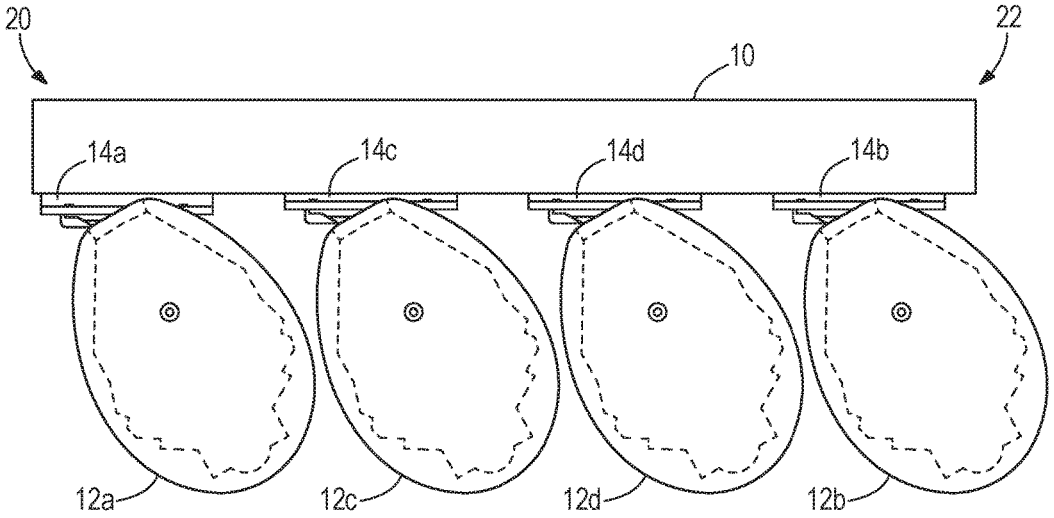
FIG. 3 illustrates a transom of a marine vessel shown from a top view with four outboard motors coupled thereto.

FIG. 1 illustrates a transom 10 of a marine vessel to which three marine propulsion devices 12*a*, 12*b*, 12*c* are coupled. Here, each of the propulsion devices 12*a*-12*c* is an outboard motor that is coupled to the transom 10 by way of a mounting bracket 14*a*-14*c*, as known to those having ordinary skill in the art. However, for purposes of the disclosure provided herein, the propulsion devices 12*a*-12*c* could just as well be sterndrives, for example as shown and described in the above-incorporated U.S. Pat. No. 4,776,818. A first propulsion device 12*a* is coupled to the far port side 20 of the transom 10, a second propulsion device 12*b* is coupled to the far starboard side 22 of the transom 10, and a third propulsion device 12*c* straddles a centerline 13 of the transom 10. The propulsion devices are able to be trimmed up and down with respect to the transom 10 by way of trim actuators (such as, but not limited to, hydraulic cylinders, pneumatic cylinders, or electric-linear actuators) to different trim positions as shown in FIGS. 1-3 of the above-incorporated U.S. Pat. No. 7,416,456. Various types, configurations, and functionalities of trim actuators used to provide such rotation are well-known in the art, and are therefore not described further herein. For one example of a trim actuator, refer to U.S. Pat. No. 4,050,359, incorporated by reference above.

The present disclosure provides methods for controlling multiple trim actuators that trim two, three, or more propulsion devices coupled to a transom of a marine vessel, for reasons that will be discussed with respect to FIG. 2. In FIG. 2, a V-shaped hull 16 of a marine vessel is shown schematically with the outlines of three propellers 18*a*, 18*b*, 18*c* outlined as they would appear from a rear view of the transom 10. Because the majority of vessel installs desire the visual aesthetics of propulsion devices that are mounted level with one another, typically, the marine propulsion devices 12*a*-12*b* to which the propellers 18*a*-18*c* are coupled will be installed at the same height on the transom 10. Additionally, the majority of propulsion devices will be mounted symmetrically with respect to the centerline 13 of the transom 10, such that a distance D between the centerline 13 and the rotation axis 19*a*, 19*b* of each propeller 18*a*, 18*b* of a propulsion device 12*a*, 12*b* on either side of the centerline 13 is the same. However, especially for non-flat bottomed hulls, the combination of dead rise, drive separation, and, for example, five-inch gear case increments will typically result in unequal propeller areas working on the water if the propulsion devices are installed level with one another and also trimmed to the same level. This results in less than optimal vessel performance.

For example, in FIG. 2, the device to which propeller 18*a* is coupled is trimmed higher than that to which propeller 18*b* is coupled, and the two propellers 18*a*, 18*b* do not have the same area in the water. Propellers 18*c* and 18*c*' show the same device being trimmed to different levels, where propeller 18*c* is trimmed lower than propeller 18*c*'. The device to which propeller 18*a* is coupled is trimmed the same as that to which propeller 18*c* is coupled, but the two propellers do not have the same area in the water. In contrast, the propellers 18*a* and 18*c*' do have the same area in the water, despite the fact that the device to which propeller 18*c*' is coupled is trimmed to a higher trim position than that of 18*a*. Note also that the propellers 18*b* and 18*c* have the same area in the water, even though they are not trimmed to the same position.

Further, hull designs that include pads, setbacks and/or unique notches can also contribute to the effect that a given propeller will have on producing thrust to propel the marine vessel as well as on adjusting its attitude in the water. Nonetheless, most operators simply use a "trim-all" button (that trims each of the two, three, four, or more propulsion devices to the same trim position) and accept less than optimized running behavior, or they manually command each propulsion device independently to an optimized trim angle, which takes time and requires a free hand. The present inventors realized that because vessels equipped with two, three, or more marine propulsion devices typically benefit from different trim angles between pairs (or sets) of outer and inner propulsion devices for optimal efficiency, user controls could be provided to achieve differentially trimmed propulsion devices in a faster, easier, and more intuitive way. The present inventors discovered that automatically assigning the propulsion devices 12*a*-12*d* into first or second sets of propulsion devices and trimming all devices in a given set in the same manner is efficient, because each propulsion device in a set is at the same level on the transom 10 as the other and is equally spaced from the keel. Thus, the propulsion devices in one set can be treated independently from the propulsion devices in another set without fear of substantially upsetting the roll or steering of the vessel.

For example, FIG. 3 shows an instance in which four propulsion devices 12*a*-12*d* are provided on the transom 10 of a marine vessel by way of mounting brackets 14*a*-14*d*. It can be seen from study of FIG. 2 that it may be desirable to trim up the inner propulsion devices (12*c* and 12*d*) on a V-shaped hull more than the propulsion devices towards the outer edges (12*a* and 12*b*) of a V-shaped hull. Recall that propellers 18*a* and 18*c*' have the same area in the water and that the device to which propeller 18*c*' is coupled is trimmed to a higher trim position than that of 18*a*. Trimming the inner propulsion devices (12*c* and 12*d*) on a V-shaped hull more than the outer propulsion devices (12*a* and 12*b*) would ensure that the propellers of each of the devices 12*a*-12*d* have a roughly equivalent area in the water and therefore a roughly equivalent effect on positioning and propelling the vessel, all else being equal. Similar principles apply to hulls of different shapes other than that shown herein.

In an automatic trimming (auto-trim) mode, a controller 26 (described herein below with respect to FIG. 5) sends commands to automatically trim the propulsion devices 12*a*, 12*b* to target trim angles that are determined as a function of vessel operating conditions, such as those operating conditions that are directly measured using sensors or calculated based on other measured factors. Some examples of such vessel operating conditions are vessel speed, engine speed, fuel economy, and/or vessel pitch. The target trim angles can be determined using any type of function, input-out map (such as a look-up table), or similar algorithm that accepts one or more vessel operating conditions as inputs and outputs a target trim angle. Generally, an operator initiates auto-trim mode once a vessel is on-plane, when variations in trim position of the propulsion devices 12*a*-12*d* can greatly affect the handling, ride, and fuel efficiency of the marine vessel. For an exemplary description of auto-trim mode, see the above-incorporated U.S. Pat. No. 7,416,456. Through research and development, the present inventors realized that development of auto-trim algorithms for multi-propulsion device applications produced a few challenges that needed to be overcome for an acceptable level of refinement and improved performance. For instance, propulsion devices should not seem overly busy and should not initiate trim commands independently of one another unless triggered by a user input. This is because automatically trimming one of multiple propulsion devices by itself with a controller may cause slight disturbances to the direction and/or roll angle of the marine vessel, which were not intended or expected by the operator. Additionally, as described herein above with respect to FIGS. 2 and 3, multi-propulsion device boats such as triple and quad applications were also observed to require unique target trim angles for different sets of propulsion devices, such for outer propulsion devices 12*a*, 12*b* compared to inner propulsion devices 12*c*, 12*d*.

Figure 7:
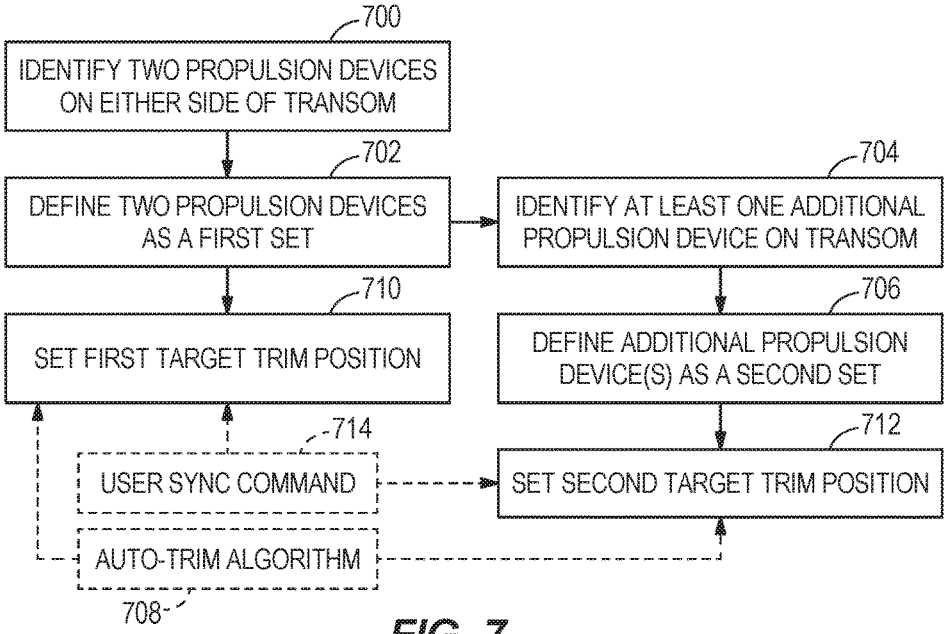
FIG. 7 illustrates one example of a method for setting target trim positions for the sets of propulsion devices.

Therefore, according to the present disclosure, a controller 26 carries out a method for positioning two or more trimmable marine propulsion devices 12*a*-12*d* coupled to a transom 10 of a marine vessel and powered by internal combustion engines. Referring to FIGS. 1, 3, and 7, in one example, the method includes identifying two propulsion devices located one on each of a port side 20 and a starboard side 22 of a vertical centerline 13 of the transom 10 and spaced symmetrically with respect to the centerline 13 of the transom 10, as shown at box 700. These propulsion devices may be, for example, 12*a* and 12*b*. The controller 26 then defines the two propulsion devices 12*a*, 12*b* as a first set of propulsion devices, as shown at box 702. The method may further include identifying at least one additional propulsion device coupled to the transom 10 of the marine vessel, such as third and fourth propulsion devices 12*c* and 12*d*, as shown at box 704. The controller 26 then defines the at least one additional propulsion device 12*c* (and, if applicable, 12*d*) as a second set of propulsion devices, as shown at box 706. In fact, for any number of propulsion devices (five, six, etc. . . . ) the same principles of assigning propulsion devices to sets, working from the outside of the transom in, will apply.

Figure 5:
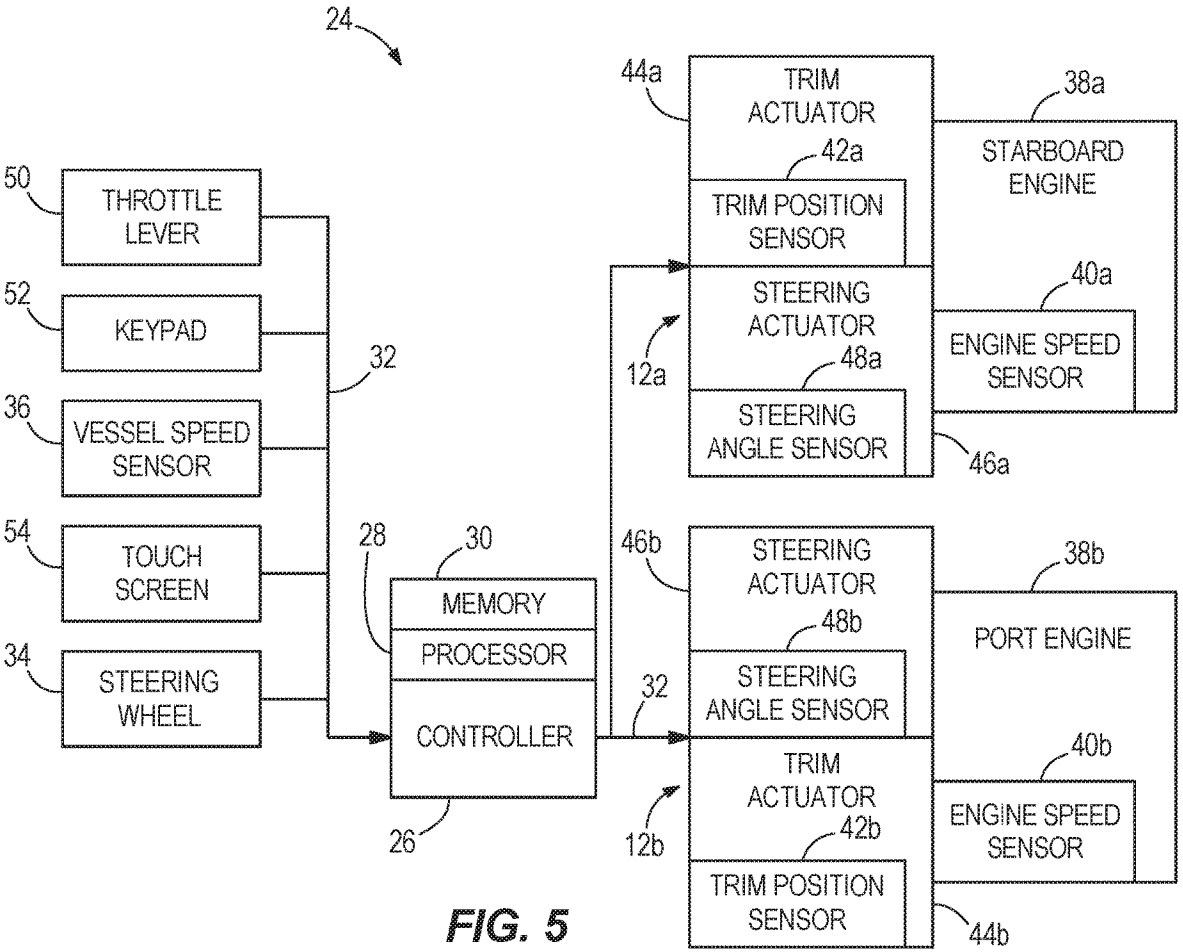
FIG. 5 illustrates one example of a control system for controlling trim positions of two or more trimmable marine propulsion devices on a marine vessel.

FIG. 5 shows a schematic of a control system 24 associated with the marine vessel. In the example shown, the system 24 includes a controller 26, which is programmable and includes a processor 28 and a memory 30. The controller 26 can be located anywhere in the system 24 and/or located remote from the system 24 and can communicate with various components of the marine vessel via wired and/or wireless links, as will be explained further herein below. Although FIG. 5 shows one controller 26, the system 24 can include more than one controller. For example, the system 24 can have controllers located at or near a helm of the marine vessel and can also have controllers located at or near the propulsion devices 12*a*, 12*b*. Portions of the method disclosed herein below can be carried out by a single controller or by several separate controllers. Each controller can have one or more control sections or control units. One having ordinary skill in the art will recognize that the controller 26 can have many different forms and is not limited to the example that is shown and described. For example, a single controller 26 is shown as carrying out the trim control method for both propulsion devices 12*a*, 12*b*, but in other examples separate controllers could be provided for each propulsion unit.

In some examples, the controller 26 may include a computing system that includes a processing system, storage system, software, and input/output (I/O) interfaces for communicating with devices such as those shown in FIG. 5, and about to be described herein. The processing system loads and executes software from the storage system, such as software programmed with a trim control method. When executed by the computing system, trim control software directs the processing system to operate as described herein below in further detail to execute the trim control method. The computing system may include one or many application modules and one or more processors, which may be communicatively connected. The processing system can comprise a microprocessor (e.g., processor 28) and other circuitry that retrieves and executes software from the storage system. Processing system can be implemented within a single processing device but can also be distributed across multiple processing devices or sub-systems that cooperate in existing program instructions. Non-limiting examples of the processing system include general purpose central processing units, applications-specific processors, and logic devices.

The storage system (e.g., memory 30) can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

In this example, the controller 26 communicates with one or more components of the system 24 via a communication link 32, which can be a wired or wireless link. The controller 26 is capable of monitoring and controlling one or more operational characteristics of the system 24 and its various subsystems by sending and receiving control signals via the communication link 32. In one example, the communication link 32 is a controller area network (CAN) bus, but other types of links could be used. It should be noted that the extent of connections of the communication link 32 shown herein is for schematic purposes only, and the communication link 32 in fact provides communication between the controller 26 and each of the sensors, devices, etc. described herein, although not every connection is shown in the drawing for purposes of clarity.

As mentioned, the controller 26 receives inputs from several different sensors and/or input devices aboard or coupled to the marine vessel. For example, the controller 26 receives a steering input from a steering wheel 34. The controller 26 is also provided with an input from a vessel speed sensor 36. The vessel speed sensor 36 may be, for example, a pitot tube sensor, a paddle wheel type sensor, or any other speed sensor appropriate for sensing the actual speed of the marine vessel. The vessel speed may instead be obtained by taking readings from a GPS device, which calculates speed by determining how far the vessel has traveled in a given amount of time. The propulsion devices 12*a*, 12*b* are each powered by an engine 38*a*, 38*b*, the speed of which is measured by engine speed sensors 40*a*, 40*b*, such as but not limited to tachometers, that determine a speed of the engines 38*a*, 38*b* in rotations per minute. The engine speeds can be used along with other measured or known values to approximate a vessel speed (i.e., to calculate a pseudo vessel speed). Trim position sensors 42*a*, 42*b* are provided for sensing actual positions of trim actuators 44*a*, 44*b*, for example, by measuring a relative position between two parts associated with the trim actuators 44*a*, 44*b*. The trim position sensors 42*a*, 42*b* may be any type of sensor known to those having ordinary skill in the art, for example Hall effect sensors or potentiometers. A steering actuator 46*a*, 46*b* and steering angle sensor 48*a*, 48*b* can also be provided for each propulsion device 12*a*, 12*b*. FIG. 5 shows an instance in which there are only two propulsion devices 12*a*, 12*b*, but it should be understood that similar actuators and sensors are provided for each propulsion device if more than two propulsion devices are provided on the transom 10.

Figure 4:
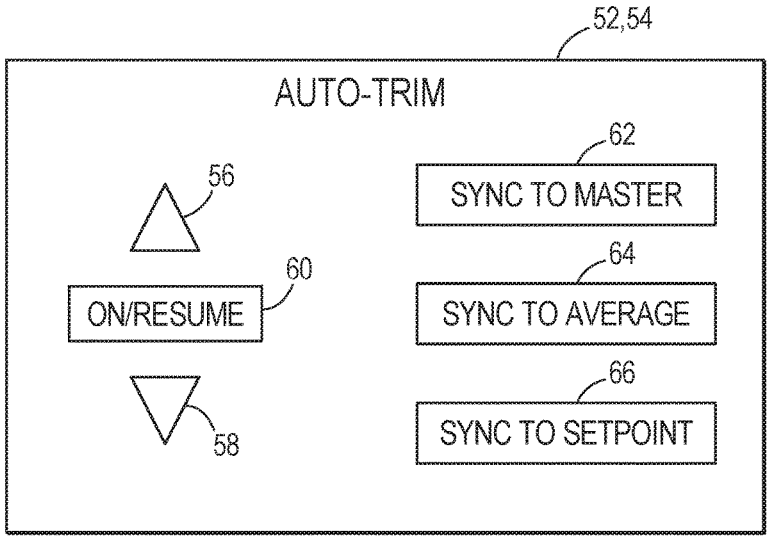
FIG. 4 illustrates one example of a keypad or touchscreen user input device for initiating methods disclosed herein below.

Other inputs to the system 24 can come from operator input devices such as a throttle lever 50, a keypad 52, and a touchscreen 54. The throttle lever 50 allows the operator of the marine vessel to choose to operate the vessel in neutral, forward, or reverse, as is known. The keypad 52 can be used to initiate or exit any number of control or operation modes (such as the auto-trim mode), or to make selections while operating within one of the selected modes. In one example, referring to FIG. 4, the keypad 52 comprises an interface having a "trim up" button 56 that commands the propulsion devices 12*a*, 12*b* to rotate relatively up out of the water, a "trim down" button 58 that commands the propulsion devices 12*a*, 12*b* to rotate relatively further down into the water, and an "auto-trim on/resume" button 60 that initiates or resumes the auto-trim mode. The touchscreen 54 can also be used to initiate or exit any number of control or operation modes (such as trim up, trim down, or auto-trim mode), and in that case the inputs can be buttons in the traditional sense or selectable screen icons. The touchscreen 54 can also display information about the system 24 to the operator of the vessel, such as engine speed, vessel speed, trim angle, trim operating mode, vessel acceleration rate, etc.

Figure 6:
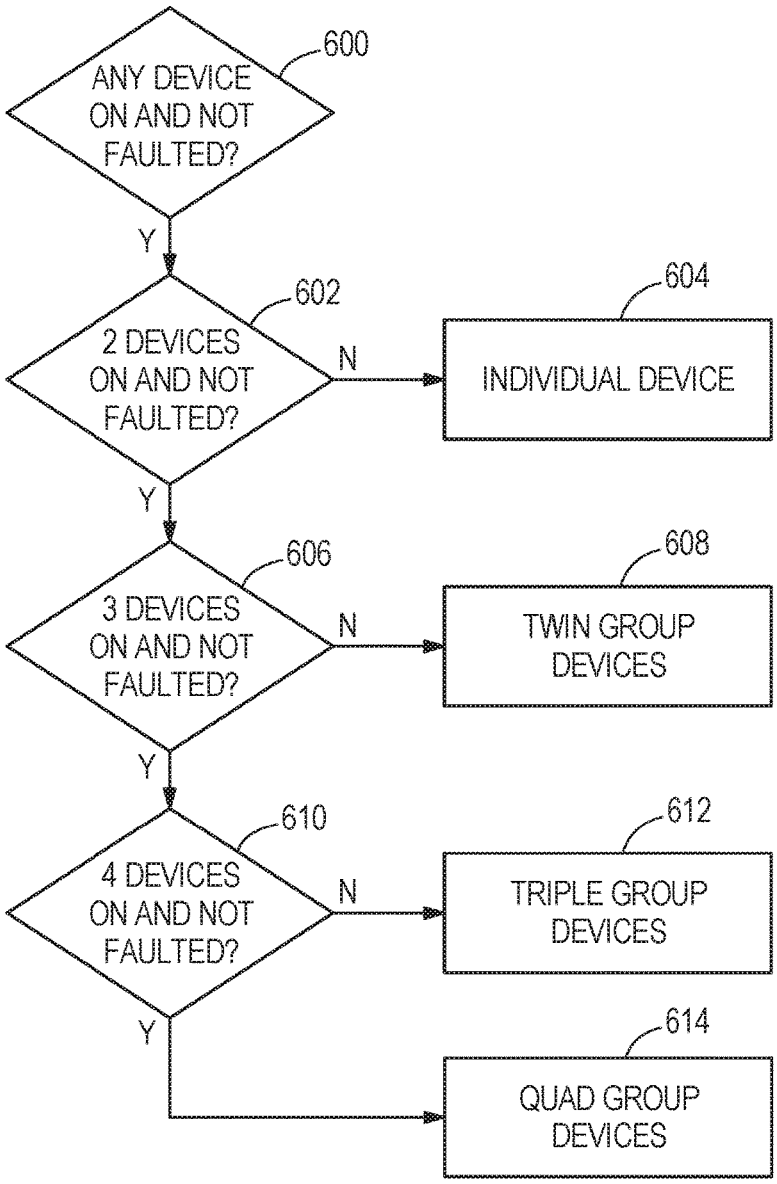
FIG. 6 illustrates one example of a method for determining how to assign propulsion devices on a marine vessel into sets of propulsion devices.

FIG. 6 illustrates one example of how the controller 26 can automatically assign propulsion devices into first and second sets of propulsion devices based on an identification of which of the propulsion devices 12*a*-12*d* on the transom 10 are turned on and not in a fault state. By way of example, if a first determination at box 600 is that any propulsion device is on and not faulted, the logic will flow to box 602, where the controller 26 will determine if there are two propulsion devices that are on and not faulted. If NO, the logic continues to box 604, and the controller 26 determines that only an individual propulsion device needs to be controlled. If YES at box 602, the controller 26 then determines if three propulsion devices are on and not faulted. If NO, the logic continues to box 608, and the controller 26 commands that the two propulsion devices that are on and not faulted should be twinned together in a first set. If YES at box 606, the logic continues to box 610, where the controller 26 determines if there are four propulsion devices on and not faulted. If NO, the logic continues to box 612, where a triple group of propulsion devices will be created. From here, the controller 26 may keep all three propulsion devices grouped together in a single set, or can group the propulsion devices into first and second sets of propulsion devices, such as an outer pair of propulsion devices 12*a*, 12*b* and an inner single propulsion device 12*c* as shown in FIG. 2. In this example, the second set of propulsion devices would contain only the one propulsion device 12*c* that straddles the centerline 13 of the transom 10. If YES at box 610, the logic progresses to box 614, and the controller 26 creates a quad group of propulsion devices. From here, the controller 26 may keep all four propulsion devices grouped together, or can group the propulsion devices into sets of propulsion devices, such as an inner pair 12*c*, 12*d* and an outer pair 12*a*, 12*b* as shown in FIG. 3. The same method is carried out for however many propulsion devices are on the vessel, and a third set of propulsion devices can be created. After boxes 612 or 614, whether the controller 26 combines all propulsion devices 12*a*-12*c* or 12*a*-12*d* into a single set or splits them into two sets can be calibrated based on the type of vessel the system 24 is installed on and/or other applicable factors, or can be selected by the operator, for example in response to a prompt on the touchscreen 54.

After assigning the propulsion devices into sets, the controller 26 can determine target trim positions for each set of propulsion devices. For example, referring again to FIG. 7, if the system 24 is programmed with an auto-trim algorithm and the auto-trim function is selected (see box 708), the controller 26 may set a first target trim position for the first set of propulsion devices as a function of a vessel operating condition, for example vessel speed, engine speed, fuel economy and/or vessel pitch (depending on the programming), as shown at box 710. The controller 26 may also set a second target trim position for the second set of propulsion devices as a function of the vessel operating condition, as shown at box 712. In one example, the first target trim position is different from the second target trim position, as might be required based on the configuration of the vessel's hull or for other reasons described herein above. In another example, the first target trim position is the same as the second target trim position.

Figure 8:
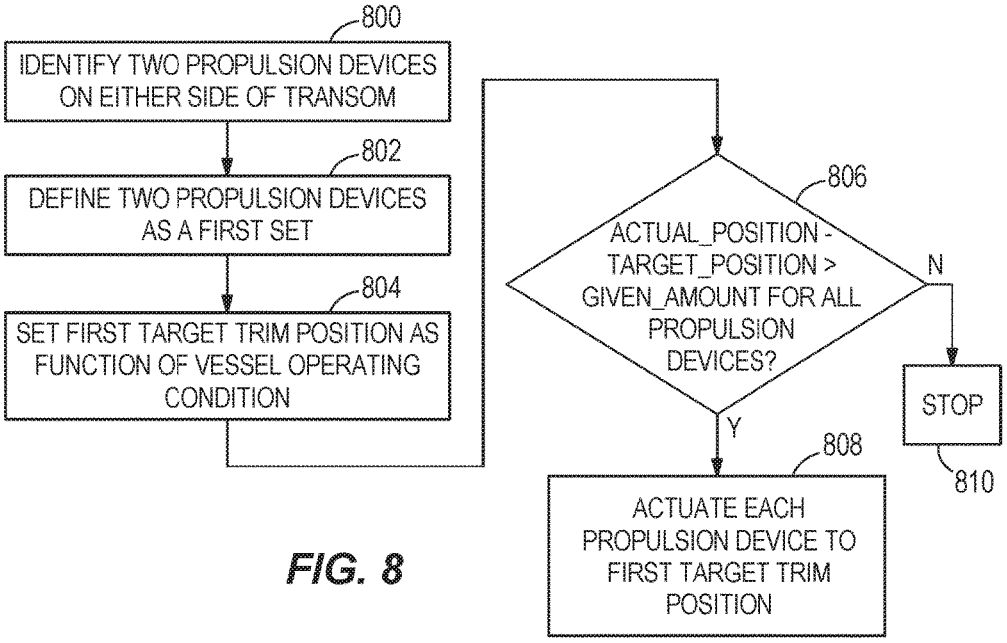
FIG. 8 illustrates one example of a method for determining whether to actuate propulsion devices in a set of propulsion devices to a target trim position.

FIG. 8 shows one example of a method for preventing busyness of the system while the system is operating in the auto-trim mode. As shown at box 800, the method includes identifying two propulsion devices 12*a*, 12*b* located one on each of a port side 20 and a starboard side 22 of a vertical centerline 13 of the transom 10 and spaced symmetrically with respect to the centerline 13 of the transom 10. As shown at box 802, the method includes defining the two propulsion devices 12*a*, 12*b* as a first set of propulsion devices. As shown at box 804, the method includes setting a first target trim position for the first set of propulsion devices as a function of the vessel operating condition. This is generally the same as the method shown in boxes 700, 702, and 710 in FIG. 7. However, as shown at box 806, the method then includes determining if an actual trim position of each propulsion device 12*a* and 12*b* in the first set of propulsion devices differs from the first target trim position by at least a given amount. If YES, the method includes actuating each propulsion device in the first set of propulsion devices to the first target trim position, as shown at box 808. If NO, the method ends at box 810. Thereafter, the method may begin again from the start or may return, for example, to box 804 or box 806. Thus, the controller 26 will actuate each propulsion device 12*a*, 12*b* in the first set of propulsion devices to the first target trim position only if the actual trim positions of all propulsion devices 12*a* and 12*b* in the first set of propulsion devices differ from the first target trim position by at least the given amount.

The same method shown in FIG. 8 may be carried out for the second set of propulsion devices, if applicable. For example, the controller 26 will also determine if an actual trim position of each propulsion device 12*c*, 12*d* in the second set of propulsion devices differs from the second target trim position by at least the given amount. The controller 26 will actuate each propulsion device 12*c*, 12*d* in the second set of propulsion devices to the second target trim position only if the actual trim positions of all propulsion devices 12*c* and 12*d* in the second set of propulsion devices differ from the second target trim position by at least the given amount. Of course, if only one propulsion device 12*c* is in the second set, then only its actual position need differ from the target by at least the given amount. Note that if three or four propulsion devices are grouped in a single set, each propulsion device 12*a*-12*c* (or 12*a*-12*d*) in the set is required to have a trim error of at least the given amount before the controller 26 will initiate a trim command.

Thus, for propulsion devices that are grouped together into sets, whether it is outers that are paired together, inners that are paired together, or all three or four propulsion devices that are grouped together, each propulsion device in the defined "set" must have an actual trim position that differs from a target trim position by at least a given amount before a command to trim is initiated. After that, all paired/grouped propulsion devices in a set are trimmed at the same time. The given amount may be quantified as the minimum controllable discrete movement that the trim actuator 44*a*, 44*b* is capable of achieving, because if a trim difference is less than this, activating the trim actuator 44*a*, 44*b* will not result in achieving the target anyhow. Thus, the method described herein avoids busyness of the trim system on vessels equipped with multiple propulsion devices, such that each propulsion device is not being trimmed independently and continually in order to attempt to achieve a target. The present method thus achieves a more coordinated and integrated functionality.

Figure 9:
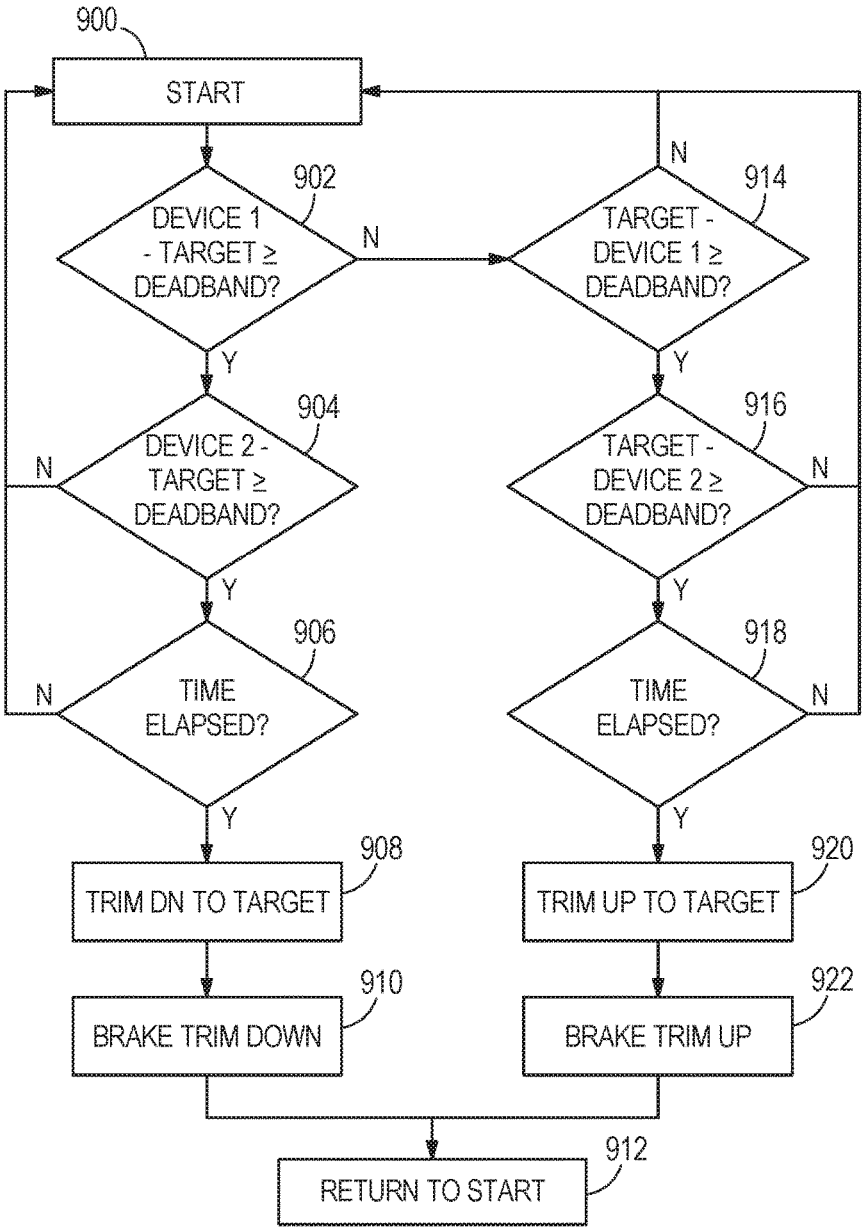
FIG. 9 illustrates another example of a method for determining whether and how to actuate propulsion devices in a set of propulsion devices to a target trim position.

Another example of an algorithm the controller 26 may use to ensure that propulsion devices in a given set are trimming only when all devices in that set have a trim error that is greater than a given amount is shown in FIG. 9. The method begins at box 900. At box 902, the controller 26 determines if an actual trim position of the first propulsion device 12*a* differs from a target trim position by at least the given amount (i.e., deadband). In other words, is DEVICE 1−TARGET≥DEADBAND? If YES, the method continues to box 904, where the controller 26 determines if an actual trim position of the second propulsion device 12*b* (in a set with the first propulsion device 12*a*) differs from the target trim position by at least the given amount. If YES, then both propulsion devices in the set (e.g., both 12*a* and 12*b*) have a position error that is greater than the given amount, and the method continues to box 906, where it is determined if a given time has elapsed since a previous command was sent to actuate all propulsion devices in the set to the target trim position. If YES, then the controller 26 will send a command to trim the propulsion devices 12*a*, 12*b* down to the target trim position, as shown at box 908. Once feedback from the appropriate trim position sensor 42*a* or 42*b* indicates that the target trim position has been reached, each propulsion device 12*a* or 12*b* will independently stop trimming. In one example, the propulsion devices may be actuated in an opposite direction for a brief period of time (i.e. braked) in order to ensure that the target trim position is achieved without overshoot, as shown at box 910. The method then returns to start as shown at box 912, and if a change in the vessel operating condition results in a new target trim position, the method begins again.

If the answer at box 902 is NO, the method instead continues to box 914, and the controller 26 determines if the difference between the target and actual trim positions for the first propulsion device 12*a* is at least the given amount. In other words, is TARGET−DEVICE 1≥DEADBAND? If YES, the method continues to box 916, where the controller 26 determines if the difference between the target and actual trim positions for the second propulsion device 12*b* is at least the given amount. If YES, the method continues to box 918 to determine if the given time has elapsed. If YES, the method continues to box 920 and both propulsion devices 12*a*, 12*b* are trimmed up toward the target trim position. Once feedback from the trim position sensors 42*a*, 42*b* indicates that the target trim position has been reached by each propulsion device independently, the method may then include briefly trimming down to prevent overshoot, as shown at box 922. The method then returns to start as shown at box 912.

If the answer at box 904 is NO, then only one of the propulsion devices has a trim position error greater than the given amount, and the method returns to start at 900. Thus, the controller 26 actuates each propulsion device in the first set of propulsion devices to the first target trim position only if a given time has elapsed since a previous command was sent to actuate all propulsion devices in the first set of propulsion devices to the first target trim position. This prevents busyness of the system by limiting corrective trim commands to times when both propulsion devices in a set have trim error that exceeds the deadband. Additionally, if the answer at box 906 is NO (i.e. the time since a previous corrective trim command was sent has not elapsed), then the method also returns to start at 900. This prevents busyness of the system by limiting the frequency of corrective trim commands. Similarly, if the answer at boxes 916 or 918 is NO, the method returns to start at 900. If the answer at box 914 is NO, then one of the propulsion devices in the set does not have a trim error that is at least the given amount and the system will not initiate trimming.

Note that the method diagram in FIG. 9 shows logic only for one propulsion device in one set of propulsion devices, but corresponding logic controls trimming of other propulsion devices in the same set as the one propulsion device. Corresponding logic also controls trimming of propulsion devices in other, distinct sets.

A "first pass" state may be set upon entry into the method of FIG. 9 and is reset after the first trim command. While first pass is true, each propulsion device ignores its peer's error. This ensures that there is some response to the user enabling or resuming the trim feature by pressing an input button (see FIG. 4). After trim commands have been made, first pass is set to false, and trimming will not be initiated until each propulsion device in a set has a trim position error that is at least the given amount. See boxes 902, 904, 914, and 916.

Also after assigning the propulsion devices into sets as discussed herein above with respect to FIG. 7, in one example, a user can input one of several different requests via a user input device for a certain type of trim synchronization function to be carried out, as shown at box 714. This can be done, for example, using the keypad 52 or touch-screen 54 shown in FIG. 4. The synchronization functions can be implemented on vessels with or without auto-trim capabilities. The synchronization functions can also be implemented without running in auto-trim mode, but could also "interrupt" auto-trim mode if it is running. For example, referring to FIG. 4, the user can input a synchronize-to-master user sync command by selecting button 62, in response to which the controller 26 sets the first and second target trim positions as a current trim position of one of the propulsion devices in the first and second sets of propulsion devices that has been predefined as a master propulsion device. Such pre-definition of the master propulsion device can be calibrated or selected by the user beforehand. The user can alternatively input a synchronize-to-average user sync command by selecting button 64, in response to which the controller 26 sets the first and second target trim positions as an average of current trim positions of all of the propulsion devices in the first and second sets of propulsion devices. Alternatively, the user can input a synchronize-to-setpoint user sync command by selecting button 66, in response to which the controller 26 sets the first target trim position to a first trim setpoint that is based on a current vessel operating condition, such as for example vessel speed, engine speed, fuel economy, and/or vessel pitch) and sets the second target trim position to a second trim setpoint that is based on the current vessel operating condition. The first and second trim setpoints can be the same as one another or can be different from one another, depending on the optimal trim position for each set or pair of propulsion devices based on the current vessel operating condition.

When the user inputs a command to initiate a given synchronization function, all propulsion devices 12*a*-12*d* will independently compare their actual trim position to the newly set target trim position. The controller 26 will independently command each propulsion device for which the difference is at least a given amount (i.e. exceeds a deadband) to match the new target trim position. In other words, the methods of FIGS. 8 and 9 (requiring all propulsion devices in a set to have trim error that is at least the given amount) are not applied. This is allowable because the user had to physically initiate the command to synchronize trim and will expect that he may possibly need to counteract the change in attitude of the vessel due to his input. In one example, if full-functioning auto-trim is enabled, the command to synchronize trim position may be input for example via the "on/resume" button 60, and all propulsion devices will immediately begin trimming to their target trim positions based on the vessel operating condition, and full auto-trim control will thereafter begin.

If the above sync algorithms are implemented when auto-trim is turned off, or on a vessel that is not equipped with auto-trim, there is no reason to determine if both or all propulsion devices in a set have trim errors greater than a given amount before initiating a trim command. Again, because the sync command is input by a user, the algorithm requires that each propulsion device compare its actual trim position to the target trim position individually and trim if necessary, as the user expects some response to his direct input. In contrast, if one of the sync commands is input while the user is operating in auto-trim mode, the controller 26 will set the first and second target trim positions in response to the user sync command. The controller 26 will then actuate an individual propulsion device in the first set of propulsion devices to the first target trim position in response to the user sync command and in response to the actual trim position of the individual propulsion device differing from the first target trim position by at least the given amount, regardless of whether the actual trim position of another individual propulsion device in the first set of propulsion devices differs from the first target trim position by at least the given amount. The controller 26 will also actuate an individual propulsion device in the second set of propulsion devices to the second target trim position in response to the user sync command and in response to the actual trim position of the individual propulsion device differing from the second target trim position by at least the given amount, regardless of whether the actual trim position of another individual propulsion device in the second set of propulsion devices differs from the second target trim position by at least the given amount.

Figure 10:
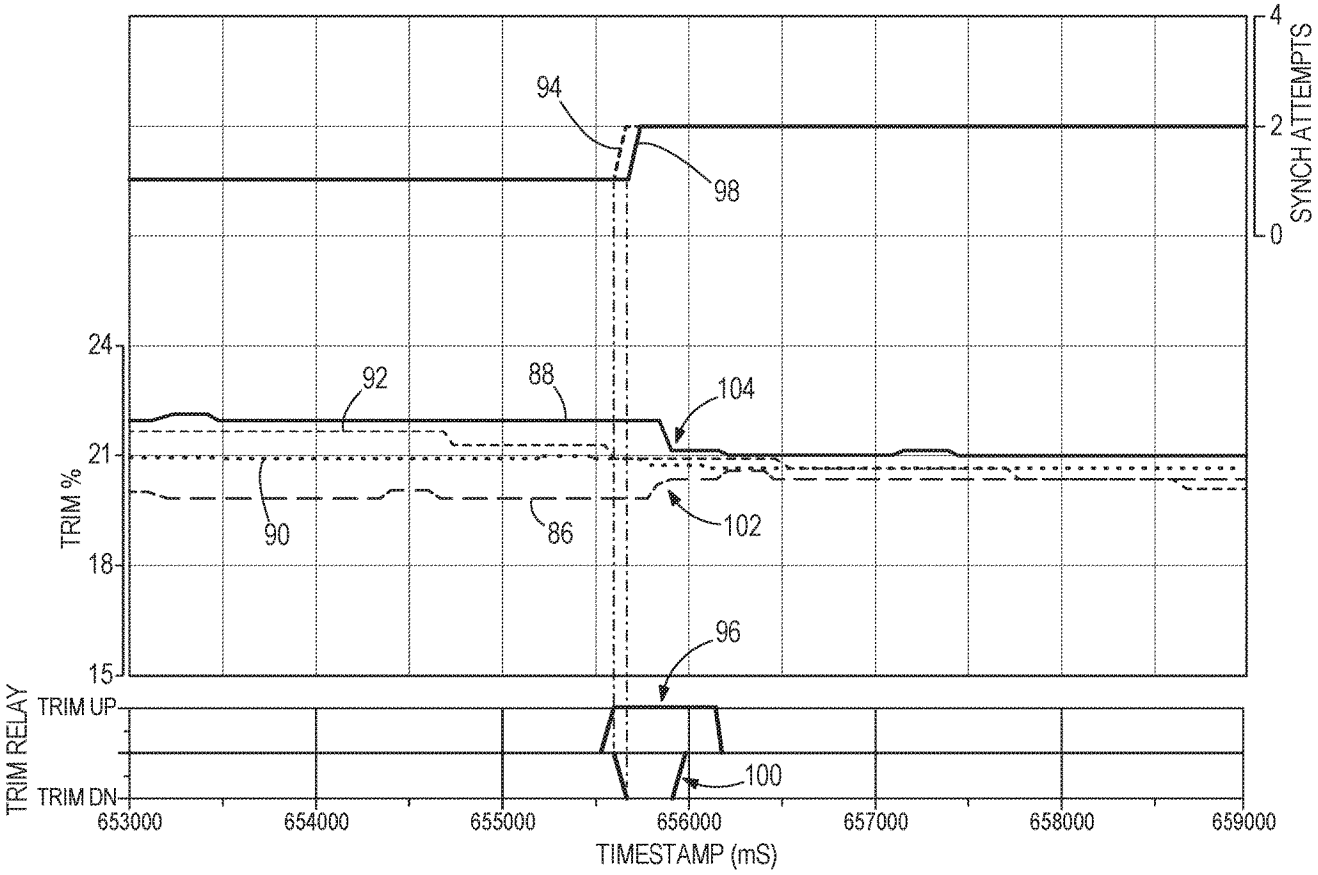
FIG. 10 is a chart showing an example of a synchronize-to-average sync event for two marine devices.

FIG. 10 shows an example of the resulting trimming of propulsion devices in response to a synchronize-to-average user sync command. The synchronize-to-average command can be input by a user via the keypad 52 or touchscreen 54 as described above, or can be programmed into the auto-trim system such that it is output every time certain conditions are met (e.g. when actual trim positions of the propulsion devices vary by at least a given amount from their average). No matter how the synchronize-to-average command is initiated, to determine if a sync event is needed, the controller 26 calculates a difference between the trim positions of each propulsion device 12*a*, 12*b* and their average trim position and then compares this difference to a given amount (i.e. a deadband saved in the memory). If the given amount is reached and/or exceeded, the controller 26 commands the propulsion devices 12*a*, 12*b* to trim to their average trim position. First, the controller 26 calculates an average of the actual trim position of the first propulsion device 12*a* and the actual trim position of the second propulsion device 12*b*. Next, the controller 26 calculates a first difference between the average and the actual trim position of the first propulsion device 12*a*. The controller 26 trims the first propulsion device 12*a* toward the average when the first difference is at least the given amount. The controller 26 also calculates a second difference between the average and the actual trim position of the second propulsion device 12*b* and trims the second propulsion device 12*b* toward the average when the second difference is at least the given amount.

The chart in FIG. 10 shows activation of the trim-up relays and trim-down relays of first and second trim actuators 44*a*, 44*b* on a lower plot and trim position of the first and second propulsion devices 12*a*, 12*b* on an upper plot with respect to time. The actual trim position of the first propulsion device 12*a* is shown at 86, while the actual trim position of the second propulsion device 12*b* is shown at 88. The average of the first and second propulsion devices' actual trim positions is shown at 90. The target trim position based on the vessel operating condition for both the first and second propulsion devices 12*a*, 12*b* is shown at 92. In this example, the vessel operating condition is vessel speed, and the vessel whose behavior is being monitored is slowly decelerating; thus the target trim position 92 is decreasing. In response to the controller 26 being commanded to synchronize to average, the average 90 becomes the target trim position rather than the values determined from the vessel operating condition shown at 92. Thus, differences between the actual and target trim positions are measured from the average 90.

A little after 655,500 mS, the controller 26 determines that the actual position of the first propulsion device (shown at 86) is below the average (shown at 90) by at least the difference threshold and that the actual position of the second propulsion device (shown at 88) is above the average (shown at 90) by at least the difference threshold. Thus, the controller 26 triggers a sync attempt for the first propulsion device 12*a* as shown at 94, resulting in activation of the trim-up relay of the first propulsion device 12*a* as shown at 96. Shortly after this, the controller 26 triggers a sync attempt for the second propulsion device 12*b* as shown at 98, resulting in activation of the trim-down relay of the second propulsion device 12*b*, as shown at 100. As a result, the first propulsion device 12*a* trims up toward the average 90 (which is the setpoint) as shown at 102, and the second propulsion device 12*b* trims down toward the average 90 as shown at 104.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A method for positioning two or more trimmable marine propulsion devices coupled to a transom of a marine vessel and powered by respective internal combustion engines, the method being carried out by a controller and comprising:

identifying two propulsion devices located one on each of a port side and a starboard side of a vertical centerline of the transom and spaced symmetrically with respect to the centerline of the transom;

defining the two propulsion devices as a first set of propulsion devices;

setting a first target trim position for the first set of propulsion devices as a function of a vessel operating condition;

determining if an actual trim position of each propulsion device in the first set of propulsion devices differs from the first target trim position by at least a given amount; and actuating each propulsion device in the first set of propulsion devices to the first target trim position in response to a determination that the actual trim positions of all propulsion devices in the first set of propulsion devices differ from the first target trim position by at least the given amount.

2. The method of claim 1, wherein the given amount is a smallest achievable discrete increment of change in trim position that the propulsion devices are capable of achieving.

3. The method of claim 1, further comprising:

identifying at least one additional propulsion device coupled to the transom of the marine vessel;

defining the at least one additional propulsion device as a second set of propulsion devices;

setting a second target trim position for the second set of propulsion devices as a function of the vessel operating condition;

determining if an actual trim position of each propulsion device in the second set of propulsion devices differs from the second target trim position by at least the given amount; and actuating each propulsion device in the second set of propulsion devices to the second target trim position in response to a determination that the actual trim positions of all propulsion devices in the second set of propulsion devices differ from the second target trim position by at least the given amount.

4. The method of claim 3, further comprising:

actuating each propulsion device in the first set of propulsion devices to the first target trim position only if a given time has elapsed since a previous command was sent to actuate all propulsion devices in the first set of propulsion devices to the first target trim position; and actuating each propulsion device in the second set of propulsion devices to the second target trim position only if the given time has elapsed since a previous command was sent to actuate all propulsion devices in the second set of propulsion devices to the second target trim position.

5. The method of claim 3, wherein the second set of propulsion devices contains one propulsion device that straddles the centerline of the transom.

6. The method of claim 3, further comprising automatically assigning the propulsion devices on the transom into the first and second sets of propulsion devices based on an identification of which of the propulsion devices on the transom are turned on and not in a fault state.

7. The method of claim 3, wherein the first target trim position is different from the second target trim position.

8. The method of claim 3, further comprising:

setting the first and second target trim positions in response to a user sync command instead of as a function of the vessel operating condition;

actuating an individual propulsion device in the first set of propulsion devices to the first target trim position in response to the user sync command and in response to the actual trim position of the individual propulsion device in the first set of propulsion devices differing from the first target trim position by at least the given amount, regardless of whether the actual trim position of another individual propulsion device in the first set of propulsion devices differs from the first target trim position by at least the given amount; and actuating an individual propulsion device in the second set of propulsion devices to the second target trim position in response to the user sync command and in response to the actual trim position of the individual propulsion device in the second set of propulsion devices differing from the second target trim position by at least the given amount, regardless of whether the actual trim position of another individual propulsion device in the second set of propulsion devices differs from the second target trim position by at least the given amount.

9. The method of claim 8, wherein in response to a synchronize-to-master user sync command, the method further comprises setting the first and second target trim positions as a current trim position of one of the propulsion devices in the first and second sets of propulsion devices that has been predefined as a master propulsion device.

10. The method of claim 8, wherein in response to a synchronize-to-average user sync command, the method further comprises setting the first and second target trim positions as an average of current trim positions of all of the propulsion devices in the first and second sets of propulsion devices.

11. The method of claim 8, wherein in response to a synchronize-to-setpoint user sync command, the method further comprises setting the first target trim position to a first trim setpoint that is based on a current vessel operating condition and setting the second target trim position to a second trim setpoint that is based on the current vessel operating condition.

12. A method for positioning two or more trimmable marine propulsion devices coupled to a transom of a marine vessel and powered by respective internal combustion engines, the method being carried out by a controller and comprising:

identifying two propulsion devices located one on each of a port side and a starboard side of a vertical centerline of the transom and spaced symmetrically with respect to the centerline of the transom;

defining the two propulsion devices as a first set of propulsion devices;

identifying at least one additional propulsion device coupled to the transom of the marine vessel;

defining the at least one additional propulsion device as a second set of propulsion devices;

setting a first target trim position for the first set of propulsion devices; and setting a second target trim position for the second set of propulsion devices;

wherein the controller sets the first and second target trim positions according to one of the following:

(a) in response to a user sync command; or (b) automatically as a function of a vessel operating condition;

wherein when the controller sets the first and second target trim positions automatically as a function of the vessel operating condition, the method further comprises:

actuating each propulsion device in the first set of propulsion devices to the first target trim position in response to a determination that actual trim positions of all propulsion devices in the first set of propulsion devices differ from the first target trim position by at least a given amount; and actuating each propulsion device in the second set of propulsion devices to the second target trim position in response to a determination that actual trim positions of all propulsion devices in the second set of propulsion devices differ from the second target trim position by at least the given amount; and wherein when the controller sets the first and second target trim positions in response to the user sync command, the method further comprises:

actuating an individual propulsion device in the first set of propulsion devices to the first target trim position in response to an actual trim position of the individual propulsion device in the first set of propulsion devices differing from the first target trim position by at least the given amount; and actuating an individual propulsion device in the second set of propulsion devices to the second target trim position in response to an actual trim position of the individual propulsion device in the second set of propulsion devices differing from the second target trim position by at least the given amount.

13. The method of claim 12, wherein the given amount is a smallest achievable discrete increment of change in trim position that the propulsion devices are capable of achieving.

14. The method of claim 12, wherein in response to a synchronize-to-master user sync command, the method further comprises setting the first and second target trim positions as a current trim position of one of the propulsion devices in the first and second sets of propulsion devices that has been predefined as a master propulsion device.

15. The method of claim 12, wherein in response to a synchronize-to-average user sync command, the method further comprises setting the first and second target trim positions as an average of current trim positions of all of the propulsion devices in the first and second sets of propulsion devices.

16. The method of claim 12, wherein in response to a synchronize-to-setpoint user sync command, the method further comprises setting the first target trim position to a first trim setpoint that is based on a current vessel operating condition and setting the second target trim position to a second trim setpoint that is based on the current vessel operating condition.

17. The method of claim 12, wherein the first target trim position is different from the second target trim position.

18. The method of claim 12, further comprising:

actuating all propulsion devices in the first set of propulsion devices to the first target trim position only if a given time has elapsed since a previous command was sent to actuate all propulsion devices in the first set of propulsion devices to the first target trim position; and actuating all propulsion devices in the second set of propulsion devices to the second target trim position only if the given time has elapsed since a previous command was sent to actuate all propulsion devices in the second set of propulsion devices to the second target trim position.

19. The method of claim 12, wherein the vessel operating condition is vessel speed.

* * * * *